US009362677B1

(12) United States Patent
Cress

(10) Patent No.: US 9,362,677 B1
(45) Date of Patent: Jun. 7, 2016

(54) CROSSTALK REDUCING CONDUCTOR ORIENTATIONS AND METHODS

(71) Applicant: ADTRAN INC., Huntsville, AL (US)

(72) Inventor: Jared Cress, Huntsville, AL (US)

(73) Assignee: Adtran Inc., Huntsville, AL (US)

( * ) Notice: Subject to any disclaimer, the term of this patent is extended or adjusted under 35 U.S.C. 154(b) by 81 days.

(21) Appl. No.: 14/560,825

(22) Filed: Dec. 4, 2014

(51) Int. Cl.
*H01R 24/00* (2011.01)
*H01R 13/6461* (2011.01)
*H01R 12/71* (2011.01)

(52) U.S. Cl.
CPC ..... *H01R 13/6461* (2013.01); *H01R 12/71* (2013.01)

(58) Field of Classification Search
CPC ..... H01R 12/51; H01R 12/79; H01R 43/205
USPC ..... 439/676, 55, 941
See application file for complete search history.

(56) References Cited

U.S. PATENT DOCUMENTS 4,720,690 A * 1/1988 Popek ..... H01L 23/49822 257/E23.062
5,397,862 A * 3/1995 Bockelman ..... H01L 23/49838 174/250
5,430,247 A * 7/1995 Bockelman ..... H01L 23/528 174/250
6,057,512 A * 5/2000 Noda ..... H05K 1/0228 174/250
6,420,778 B1 * 7/2002 Sinyansky ..... H05K 1/0216 257/664
6,617,939 B1 * 9/2003 Vermeersch ..... H01R 13/719 333/172
8,357,013 B2 * 1/2013 Arai ..... H04M 1/76 379/417
2005/0202697 A1 * 9/2005 Caveney ..... H05K 1/0228 439/77
2014/0184350 A1 * 7/2014 Howard ..... H01P 3/026 333/5

* cited by examiner

*Primary Examiner* — Abdullah Riyami
*Assistant Examiner* — Nader J Alhawamdeh
(74) *Attorney, Agent, or Firm* — Fish & Richardson P.C.

(57) ABSTRACT

In accordance with a non-limiting example, a connector mates to a circuit board at a connector interface. The connector often introduces an undesirable level of crosstalk between pairs. Traces are formed on the circuit board in a "compensation region" that also introduces crosstalk between pairs. The "compensation region" is created in a geometrically controlled fashion such that the crosstalk in the compensation region is of equal magnitude, but opposing phase to the crosstalk introduced by the connector. Thus, the overall crosstalk is minimized.

19 Claims, 12 Drawing Sheets

COMPENSATOR ARRANGEMENT FOR CAT5 REQUIREMENTS

CROSSTALK REDUCING CONDUCTOR ORIENTATIONS AND METHODS

BACKGROUND

Miniature ribbon connectors such as the Champ™ ribbon connector introduce an undesirable level of crosstalk between connector pairs for some applications. As always, this crosstalk results from the specific geometry of the ribbon connector. As applications are pushing to ever higher bandwidths, a number of proposals have been made to reduce the resulting connector crosstalk. Some proposals have attempted to twist components or wires inside the ribbon connector in a unique geometric arrangement to reduce the crosstalk. This solution adds extensively to the manufacturing costs of the ribbon connector, however. Another proposal that has been commercialized is to deviate from the historical pin assignments. The historical pin assignment of tip/ring pairs in the connector, which is referred to as a "standard pinout," is not optimal from a crosstalk perspective as it creates a large amount of inductive coupling. By re-assigning the pins, the coupling can be made predominantly capacitive. Counter-balancing capacitive coupling is then built into the connector. In addition to adding significant cost, this method creates compatibility problems with a huge base of installed equipment utilizing the historical pin assignments.

SUMMARY

In accordance with a non-limiting example, a connector mates to a circuit board at a connector interface. The connector often introduces an undesirable level of crosstalk between pairs. Traces are formed on the circuit board in a "compensation region" that also introduces crosstalk between pairs. The "compensation region" is created in a geometrically controlled fashion such that the crosstalk in the compensation region is of equal magnitude but opposing phase to the crosstalk introduced by the connector. Thus, the overall crosstalk is minimized.

In one example, the compensation region is optimized geometrically to minimize the crosstalk to the nearest neighbor pairs (for example, T3/R3 to T4/R4 and T2/R2). In another example, the geometry is configured to minimize the total crosstalk from all aggressors, resulting in an effective CAT-5 compliant connector from a standard ribbon connector.

A method of forming the circuit board is also set forth.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION

The subject matter of this document will now be described more fully hereinafter with reference to the accompanying drawings. This subject matter may, however, be implemented in many different forms and should not be construed as limited to the implementations set forth herein. Rather, examples are provided so that this disclosure will be thorough and complete. Like numbers refer to like elements throughout.

Figure 1:
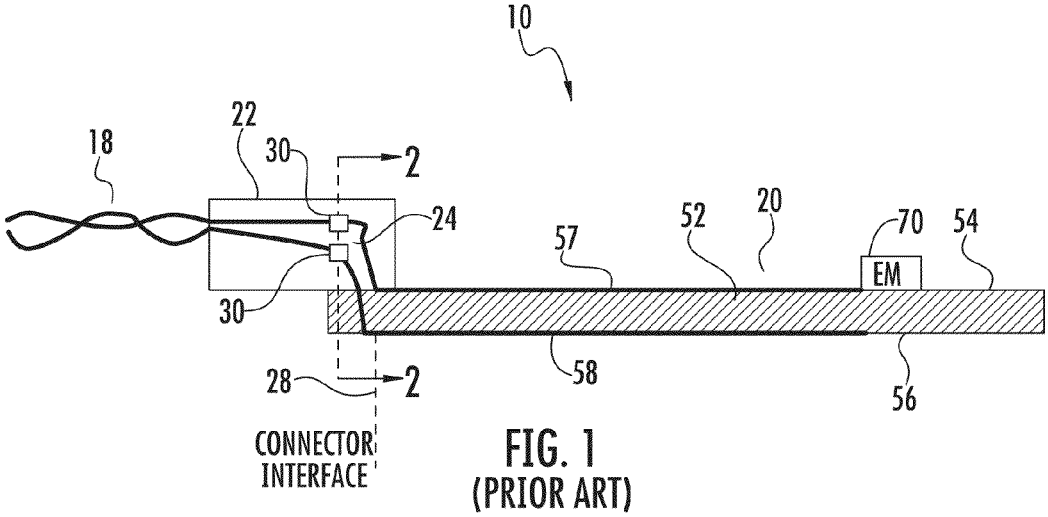
FIG. 1 (PRIOR ART)
FIG. 1 is a cross-sectional view of a circuit board and conventional connector system for coupling electronic modules on a circuit board to a connector.

FIG. 1 is a fragmentary side elevation view of a printed circuit board 20 and showing a conventional system 10 for coupling electronic modules 70 to a connector 22 and showing the unshielded twisted wire pair 18 with tip and ring conductors. The connector 22, a connector interface 28, and various pins to which the twisted pair tip and ring conductors connect are illustrated. A large conductor loop 24 is formed inside the connector. The printed circuit board 20 is formed from a substrate 52 and a first opposing side 54 and second opposing side 56, including a top trace 57 and bottom trace 58. The connector 22 in one example is formed as a right-angle connector such as the Champ™ ribbon connector.

Figure 2:
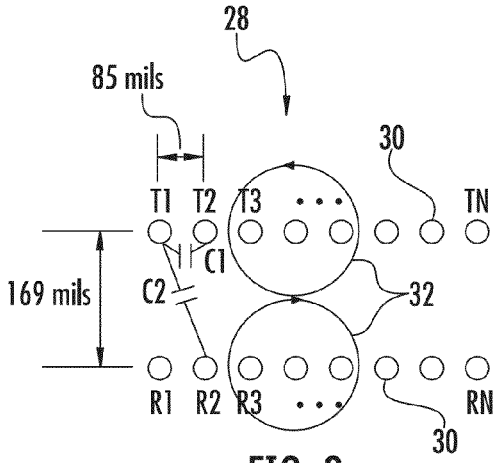
FIG. 2 is a sectional view taken along tip and ring conductors and showing the connector interface and flux lines.

FIG. 2 is a cross-sectional view taken along line 2-2 of FIG. 1 and showing a number of pins 30 and how the historical pinout geometry results in both inductive and capacitive coupling and showing example dimensions. A Tip and a Ring (e.g., T2/R2) constitute a wire pair, which is also referred to as a conductor pair or pair of conductors. The flux lines 32 from one wire pair readily penetrate other wire pair loops, creating inductive crosstalk. In addition, the pin spacing creates a capacitive imbalance where $C1 \neq C2$, resulting in capacitive crosstalk in a differential system.

Figure 3:
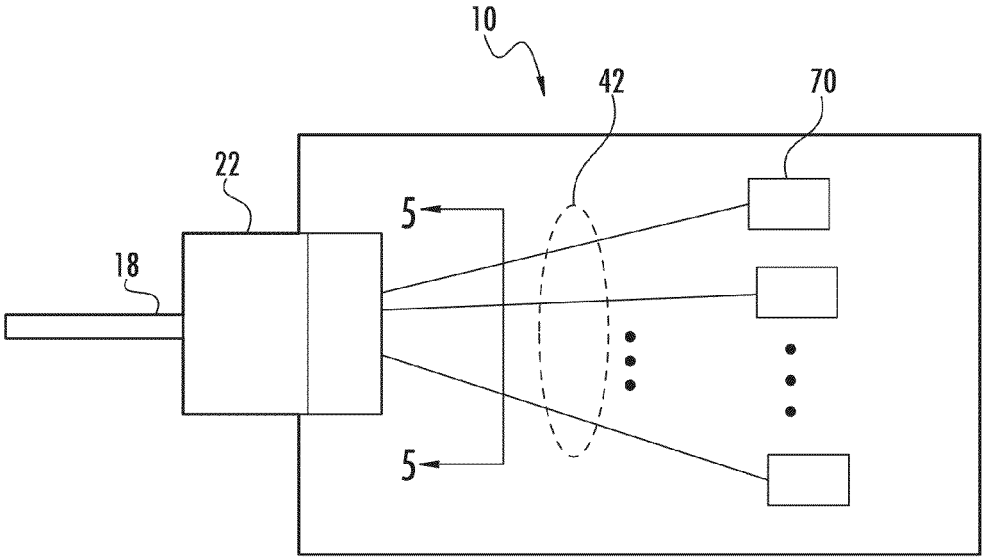
FIG. 3 (PRIOR ART)
FIG. 3 is a plan view of the conventional circuit board shown in FIG. 1.

FIG. 3 is a plan view of the conventional prior art connector system 10 such as shown in the sectional view of FIG. 1 and showing the connector 22 and the unshielded twisted pairs 18 that are associated with the connector 22. The conventional connector system 10 includes a conventional trace arrangement or fanout pattern 42 that connects to different electronic modules or components, such as transmitter/receiver or other such devices 70. In the conventional fanout pattern 42, pair-to-pair coupling is considered undesirable and is avoided as much as possible.

Figure 5:
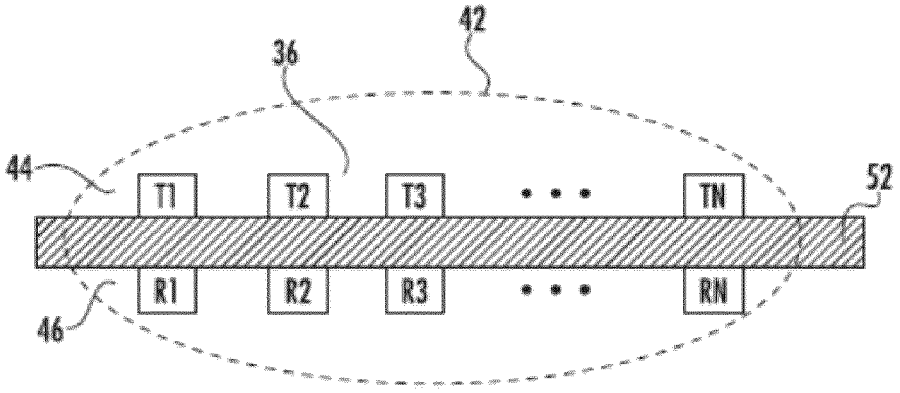
FIG. 5 (PRIOR ART)
FIG. 5 is an enlarged sectional view of the conventional trace pattern shown in FIG. 3.

FIG. 5 is a sectional view of the trace arrangement or pattern 42 on the circuit board as shown in FIG. 3 and showing the gap 36 between traces, with the top traces corresponding to the tip conductors 44 and the bottom traces corresponding to the ring conductors 46.

Figure 4:
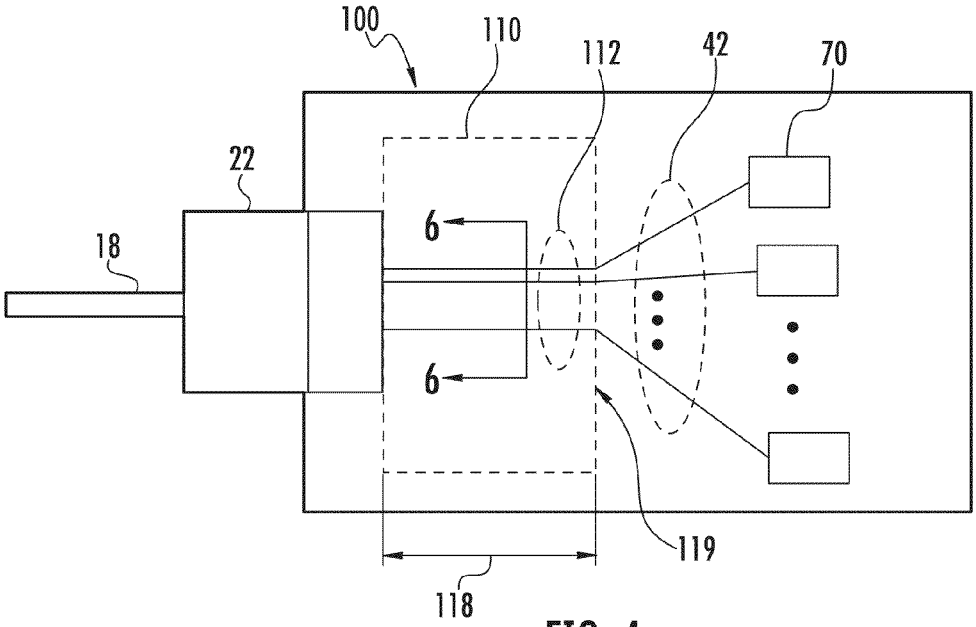
FIG. 4 is a plan view of a circuit board and showing a connector system for coupling electronic modules to the connector in accordance with a non-limiting example and showing a compensator trace pattern.

FIG. 4 is a plan view of the connector system 100 for coupling electronic modules 70 to a connector 22 in accordance with a non-limiting example, and showing a compensator 110 that includes compensator traces in which the length of the traces for the compensator are illustrated at 118. The conventional fanout pattern 42 begins after the compensator 110.

Figure 6:
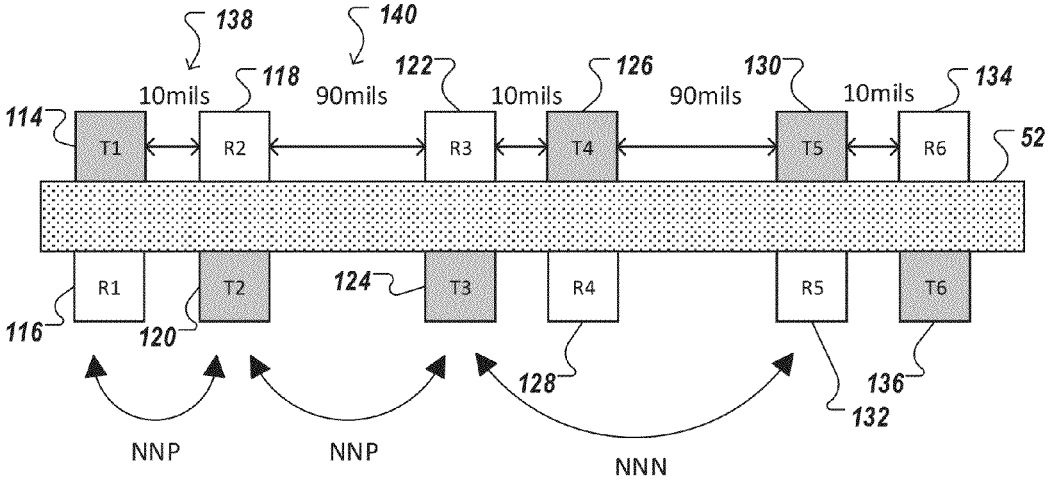
FIG. 6 is an enlarged sectional view of the compensator trace pattern shown in FIG. 4.

FIG. 6 is a sectional view of the compensator region showing the substrate 52, compensator conductors (also referred to as traces) 114, 116, 118, 120, 122, 124, 126, 128, 130, 132, 134, and 136. As illustrated by FIG. 6, conductors 114 and 116 form a first pair of conductors ("first pair"), while the conductors 118 and 120 form a nearest neighbor pair of conductors ("NNP" or "nearest neighbor") relative to the first pair (e.g., 114 and 116). As used throughout this document, an NNP is a pair of conductors that are formed adjacent to another pair of conductors. For example, conductors 118 and 120 are formed adjacent to conductors 114 and 116, such that conductors 118 and 120 are an NNP relative to the conductors 114 and 116. Similarly, conductors 114 and 116 are also considered an NNP relative to conductors 118 and 120.

Conductors 122 and 124 form a next nearest neighbor pair of conductors ("NNN" or "next nearest neighbor") relative to the first pair (e.g., conductors 114 and 116). As used throughout this document, a next nearest neighbor pair of conductors are a pair of conductors that are separated from a given pair of conductors by another pair of conductors. For example, conductors 122 and 124 are considered an NNN relative to the first pair (e.g., conductors 114 and 116) because the conductors 118 and 120 are located between the first pair and the conductors 122 and 124. Similarly, conductors 122 and 124 are an NNN relative to conductors 130 and 132 because the pair of conductors 126 and 128 are located between the pair of conductors 122/124 and the pair of conductors 130/132.

As shown in FIG. 6, the pair of conductors 118 and 120 are twisted relative to the conductors 114 and 116. That is, the tip "T1" (i.e., conductor 114) is located on one side of the substrate 52, while the tip "T2" (i.e., conductor 120) is located on a different side of the substrate 52. The conductors 122 and 124 are similarly twisted relative to the conductors 114 and 116. As discussed in more detail below, this twisting of the conductors, in conjunction with other twists in the compensation region and a layout of the conductors in the compensation region facilitate cancellation of crosstalk between the pairs of conductors caused by a connector (e.g., connector 22 of FIG. 1).

As illustrated by FIG. 6, each pair of conductors is separated from its NNP by a gap or spacing. For example, the first pair (e.g., 114 and 116) are separated from the conductors 118 and 120 by a 10 mil spacing 138. Similarly, the conductors 118 and 120 are separated from the conductors 122 and 124 by a 90 mil spacing 140.

Generally, two pairs of conductors that are closer to each other will experience a higher magnitude of crosstalk than conductors that are farther away from each other. Therefore, with reference to a given conductor pair (e.g., the first pair 114 and 116), the magnitude of crosstalk between an NNP (e.g., 118 and 120) and the given conductor pair will generally be higher than the magnitude of the crosstalk between an NNN (e.g., 122 and 124) and the given conductor pair. Accordingly, the relative relationship (e.g., NNP or NNN) of the given conductor pair to another conductor pair as well as the spacings between the pairs will be a consideration for selecting compensation coupling lengths for the various conductor pairs and/or whether any of the pairs are twisted at a point in the compensation region. As discussed in detail below, it is possible to cancel both near end crosstalk and far end crosstalk using a compensation region similar to that discussed throughout this document.

In accordance with a non-limiting example as shown in the board structures in FIGS. 4 and 6, it is possible to build trace structures 112 into the PCB and cancel the connector crosstalk. Traces on the PCB are intentionally coupled together in the "compensation" region 110 specifically designed to counter-balance the connector crosstalk. At the end of the compensation region 110 there is a reduced crosstalk interface 119, followed by the conventional fanout pattern 42 on the PCB such as shown in the plan view of FIG. 4.

The cost of this scheme is limited to the PCB real estate required to implement the compensation region trace structures in the PCB board. These trace structures can be optimized towards Near End Crosstalk (NEXT) cancellation, Far End Crosstalk (FEXT) cancellation, or a compromise between the two. Compensated CAT5-rated ribbon connectors are available at a high relative cost, though they require a non-standard pinout. In accordance with a non-limiting example, the system described herein achieves equivalent performance from a cheaper part while preserving the traditional pair assignments, if desired. It should be understood that the description is not limited to the ribbon connectors, but it can be applied to many different PCB-mounted connectors where the connector itself plus the PCB compensation region is electrically small. Also, in some embodiments, the electrical conduction can be by other than a circuit board trace, for example, by use of wire conductors, as long as the proper geometry is established.

A regular ribbon connector can be mounted on the circuit board and the geometry of the traces in the PCB are arranged to cancel the crosstalk in the ribbon connector. In an example, the traces are geometrically arranged by twisting some pairs at the connector to PCB interface. The twisting action may cause the flux lines in the PCB compensation region to be 180 degrees out of phase with the flux lines from the nearest neighbor pair in the connector. If the magnitudes of the inductive coupling are made the same, the inductive coupling is cancelled. The twisting action also allows the capacitive coupling to be balanced as well if the pair-to-pair spacing and the coupling distance are configured correctly. If the capacitance is balanced between each of the wires in the coupled pairs, capacitive coupling will be limited to the common mode, which is ignored by differential communication systems (this presumes good longitudinal balance—a hallmark of differential systems). Cancelling the flux and balancing the capacitance is controlled via the vertical and horizontal separations of the trace structures along with the length of the compensation region. The combination of the horizontal and vertical separation optimizes the induction and capacitance for crosstalk cancellation, creating a reduced crosstalk interface at the end of the compensation region on the PCB. No special manufacturing of a ribbon connector or other connector is required with this technique. Any off-the-shelf (OTS) components that are electrically small can be compensated for using this technique, and it is possible to have 20 dB improvement using special geometries. Example geometric configurations are discussed in more detail with reference to the figures that follow.

Figure 7:
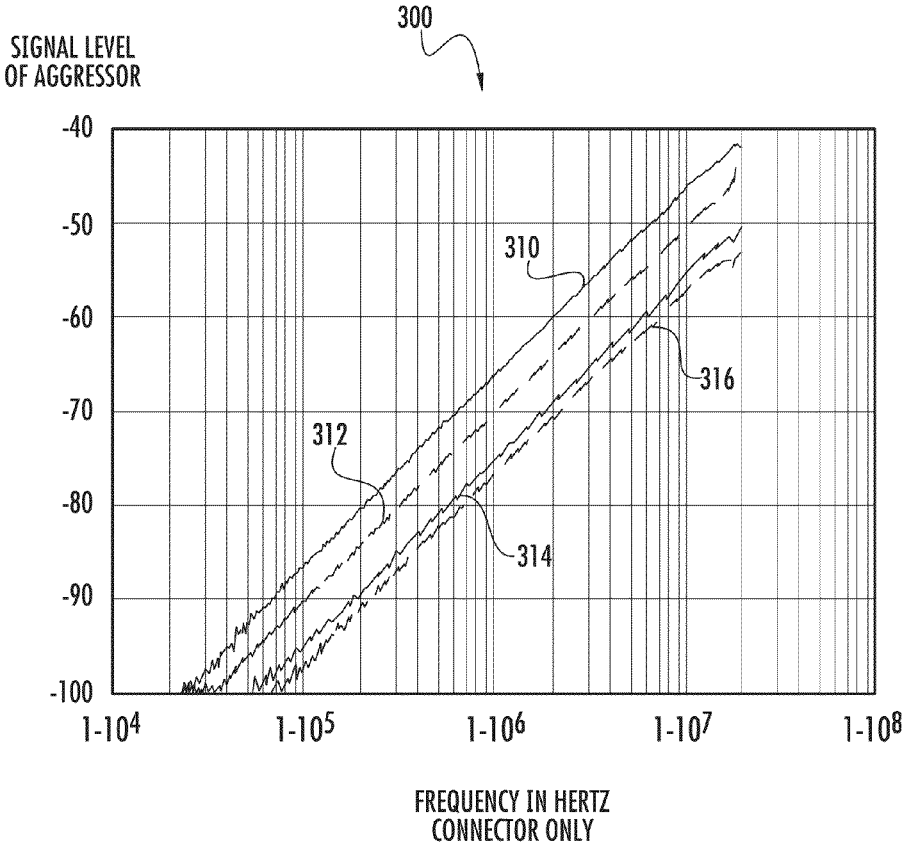
FIG. 7 is a graph of connector characteristics in accordance with a non-limiting example and showing the signal level of an aggressor on the vertical axis and frequency in hertz for the connector only on the horizontal axis.

FIG. 7 is a graph showing the crosstalk in a typical CHAMP connector that the disclosed technology is attempting to ameliorate. FIG. 7 shows the NEXT from the nearest neighbor (connector only) at 310, and the FEXT from the nearest neighbor (connector only) at 312. The NEXT from the next-nearest neighbor (connector only) is shown at 314 and the FEXT from the next-nearest neighbor for the connector only is shown at 316.

Figure 8:
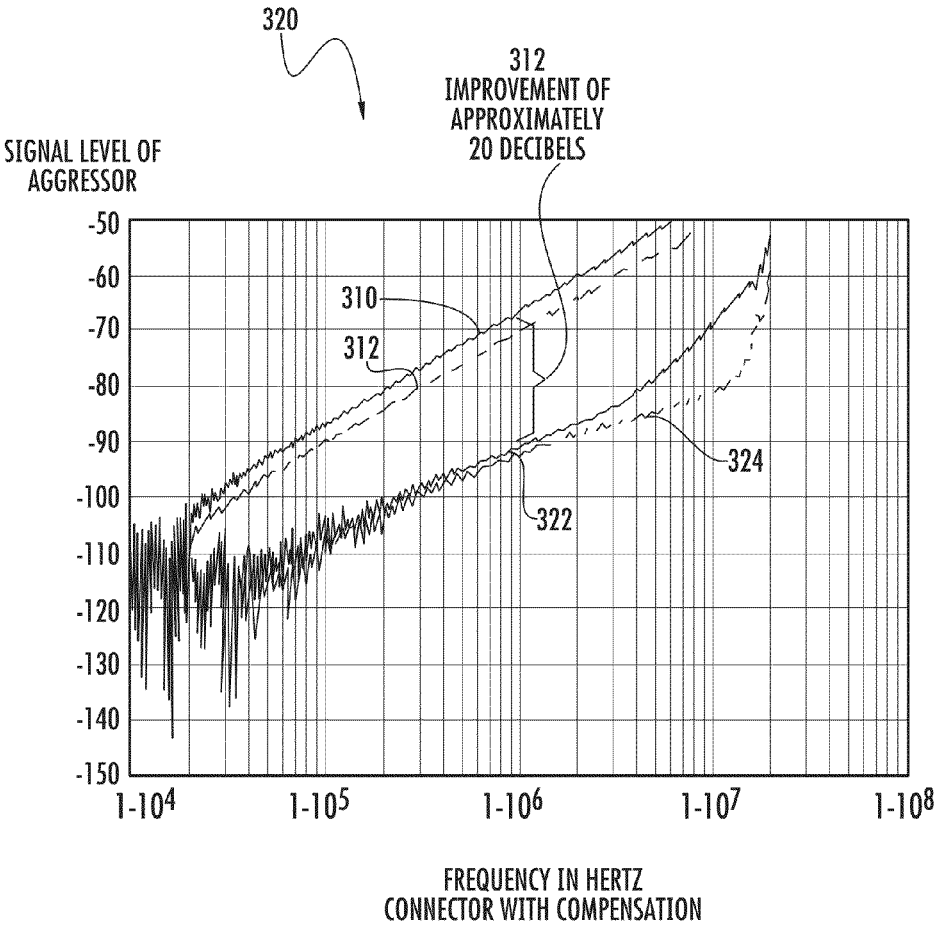
FIG. 8 is a graph similar to that shown in FIG. 7 and showing compensator improvements and showing the signal level of the aggressor on the vertical axis and the frequency in hertz on the horizontal axis.

FIG. 8 overlays the connector-only results with the results for the connector plus compensator structure when optimized for both NEXT 322 and FEXT 324 cancellation between nearest neighbors. In particular, each spacing (e.g., 138 and 140) of FIG. 6 is set to 40 mils, the length 118 is set to 4.5 inches, the trace widths are 25 mils using 2 oz copper, and the substrate thickness is 0.062 inches. The addition of the compensator drops the crosstalk by roughly 20 dB.

Figure 8A:
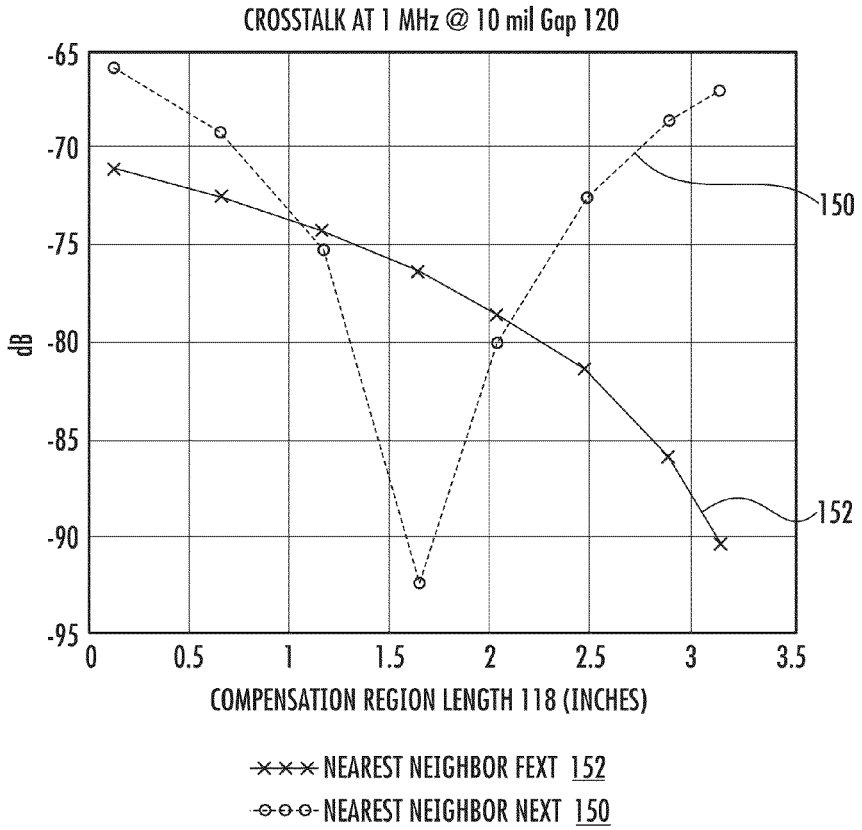
FIG. 8A is a graph showing tradeoffs between NEXT and FEXT cancellation versus compensation region length.

While the results of FIG. 8 are excellent, they require a significant amount of PCB real estate. If the system does not require simultaneous NEXT and FEXT cancellation, a smaller compensation region is possible. For instance, it is possible to reduce the spacing 138 and 140 between pairs in the compensation region 110 to 10 mils. FIG. 8A is a graph that shows the tradeoffs that can be made between NEXT 150 and FEXT 152 cancellation verses compensation region length 118 (FIG. 4). In some implementations, the structure of the compensation region (e.g., length of compensation region, spacings between conductor pairs, and location of twist points) can be selected to cancel at least a threshold amount of near end and/or far end crosstalk. For example, using graphs like that of FIG. 8A, the structure can be selected to optimize (e.g., minimize) near end crosstalk, optimize far end crosstalk, optimize both near end and far end crosstalk, or optimize cancellation of crosstalk to the next nearest pairs of a given conductor pair.

Figure 9:
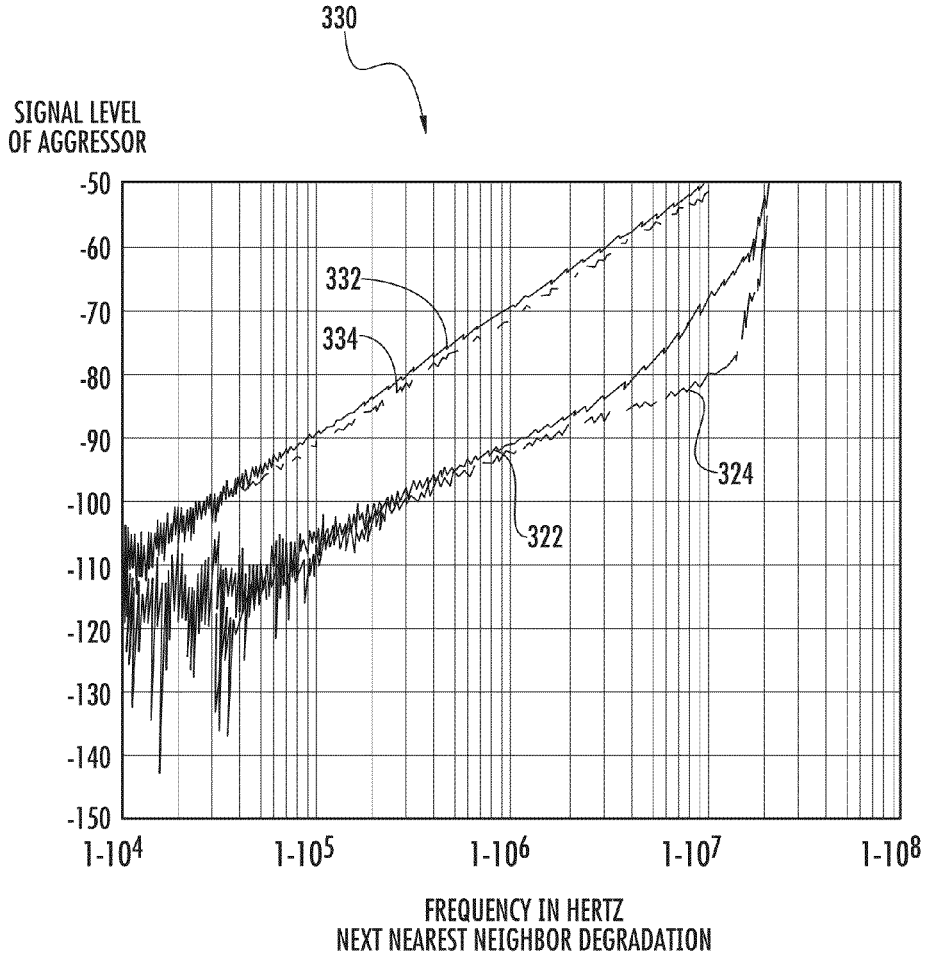
FIG. 9 is another graph similar to those shown in FIGS. 7 and 8 and showing the next-nearest neighbor (for example, T7/R7 to T9/R9) crosstalk characteristics in accordance with a non-limiting example.

When the compensation region is designed to effectively cancel the crosstalk between nearest neighbors, other couplings may become dominant. For example, the coupling to the NNN may become stronger than the cancelled NNP coupling. This is demonstrated in FIG. 9, where connector plus compensation region has driven the NNP NEXT 322 and NNP FEXT 324 far below the level of the NNN NEXT 332 and NNN FEXT 334 In many applications, the lowest aggregate coupling from all aggressors should be achieved, not just the nearest neighbors. Thus, in some implementations, compensation region design may be a structure that trades off some of the rejection to the nearest neighbor for purposes of achieving a given aggregate rejection over the compensation region.

Figure 10A:
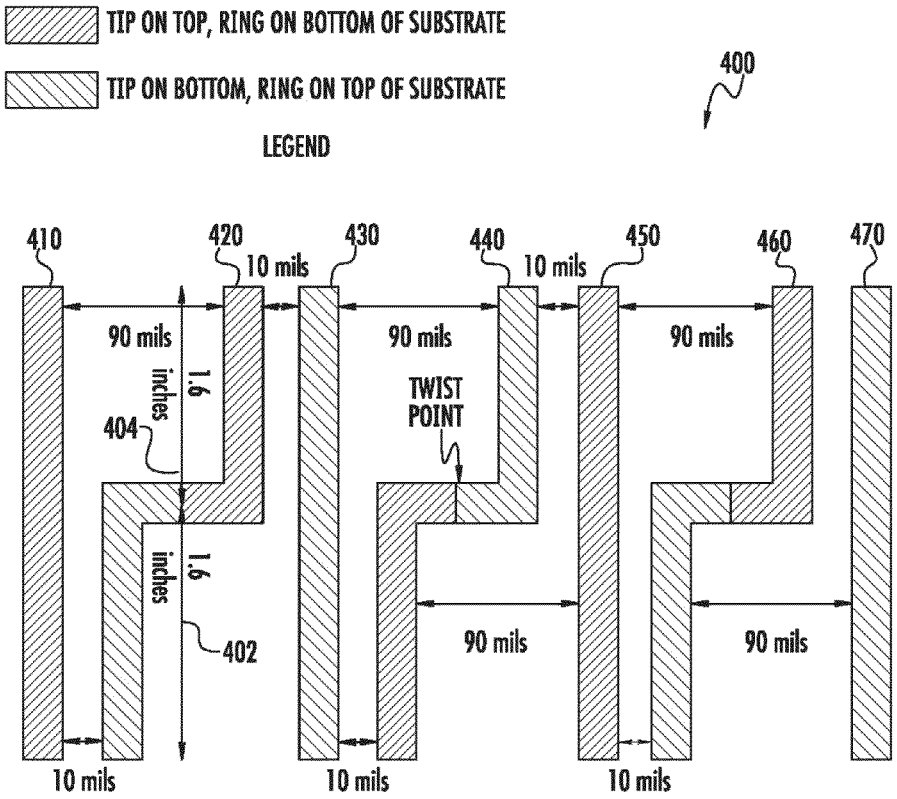
FIG. 10A is a plan view of a trace arrangement of a CAT5 compensator and configured to satisfy the CAT5 requirements.

FIG. 10A is a top view of a compensator region 400 that can be used to cancel crosstalk to satisfy CAT5 requirements for the entire connector. The conductor pairs shown at 410, 420, 430, 440, 450, 460, and 470 ("410-470" collectively) are conductors formed on a PCB. As indicated in the legend of FIG. 10A, the portions of conductor pairs 410-470 that have a top right to bottom left diagonal fill pattern (e.g., 410 and 450), referred to as the first fill pattern, represent portions of the compensation region where a tip trace is formed on a top surface of the substrate and a ring trace is formed on a bottom surface of the substrate.

For example, conductor pair 410 has the first fill pattern along an entire length (e.g., 3.2 inches) of the compensation region. Thus, for the entire length of the compensation region, the conductor pair marked 410 is a pair of conductors having a tip conductor on the top surface of the substrate and a ring conductor on the bottom surface of the substrate.

Meanwhile, conductor pair 430 has a top left to bottom right fill pattern, referred to as a second fill pattern, indicating that the conductor pair 430, which is an NNN relative to the conductor pair 410, visually represents a pair of conductors having a ring conductor on the top surface of the substrate and a tip conductor on the bottom surface of the substrate. As such, the crosstalk coupling between the conductor pair 410 and the conductor pair 430 is inverted (e.g., 180 degrees out of phase or in antiphase) relative to the crosstalk between these conductor pairs that is caused by the connector ("connector crosstalk"). Accordingly, the connector crosstalk between the conductor pair 410 and the conductor pair 430 is reduced and/or cancelled over the entire length of the compensation region.

Similar crosstalk cancellation occurs between the conductor pair 430 and the conductor pair 450 because the crosstalk coupling between the conductor pairs 430 and 450, which are next nearest neighbors, is similarly inverted relative to the connector crosstalk between conductor pair 430 and conductor pair 450. Connector crosstalk between other sets of next nearest neighbors can similarly be reduced and/or cancelled by using a similar layout.

As noted above, the distance between pairs of conductors affects the magnitude of crosstalk coupling between the pairs. Therefore, in FIG. 10A, the magnitude of crosstalk coupling between the conductor pairs represented by conductor pairs 410 and 420 will be greater than the magnitude of the crosstalk coupling between conductor pairs represented by conductor pairs 410 and 430. As such, the connector crosstalk between conductor pairs 410 and 420 can generally be reduced and/or cancelled by inverting the crosstalk coupling between the conductor pairs 410 and 420 (e.g., relative to the connector crosstalk coupling between the conductor pairs) over less than the entire length of the compensation region.

In some implementations, the spacing between the conductor pair 410 and a first portion of conductor pair 420 (e.g., the portion of conductor pair 420 formed over a first portion of the compensation region 402 that extends 1.6 inches) can be selected so that the connector crosstalk between the conductor pairs 410 and 420 can be reduced and/or cancelled based on the crosstalk coupling between the first portion of the conductor pair 420 and the conductor pair 410. For example, as illustrated by FIG. 10A, the first portion of the conductor pair 420 can be formed 10 mils (or another selected distance) away from the conductor pair 410 to cancel the connector crosstalk between the conductor pairs 410 and 420 over the 1.6 inch portion of the compensation region 402.

A twist point (shown in more detail with reference to FIG. 10B) is located approximately half way along the length of the compensation region. The twist point is a location at which a pair of conductors are twisted. For example, as shown by FIG. 10A, the conductor pair 420 are each routed to the other side of the substrate. That is, the ring trace of the conductor pair 420, which is on top of the substrate over the portion of the compensation region 402, is routed to the bottom of the substrate at the twist point and along a second portion of the compensation region.

Meanwhile, the tip conductor of the conductor pair 420 is located on the bottom of the substrate in the first portion of the compensation region, and is routed to the top of the substrate at the twist point. In some implementations, the conductors are routed through the substrate using vias (e.g., a separate via for each of the tip conductor and the trace conductor). After the twist of the conductors at the twist point, the tip conductor of conductor pair 420 remains on top over the second portion of the compensation region (e.g., the 1.6 inch portion following the twist point).

After the twist, the crosstalk coupling between the conductor pair 420 and the conductor pair 430 is inverted relative to the connector crosstalk between the conductor pair 420 and the conductor pair 430. Therefore, over the second portion of the compensation region 404, the crosstalk coupling between the conductor pair 420 and the conductor pair 430 can reduce the connector crosstalk coupling between these conductor pairs in a similar manner to that discussed above with reference to the reduction of connector crosstalk between the conductor pairs 410 and 420.

A similar conductor pair pattern can be repeated as shown in FIG. 10A to reduce connector crosstalk between multiple pairs of nearest neighbors as well as multiple pairs of next nearest neighbors. Each pair of next nearest neighbors will have an inverted crosstalk coupling relative to the connector crosstalk coupling between that pair of next nearest neighbors.

Figure 10B:
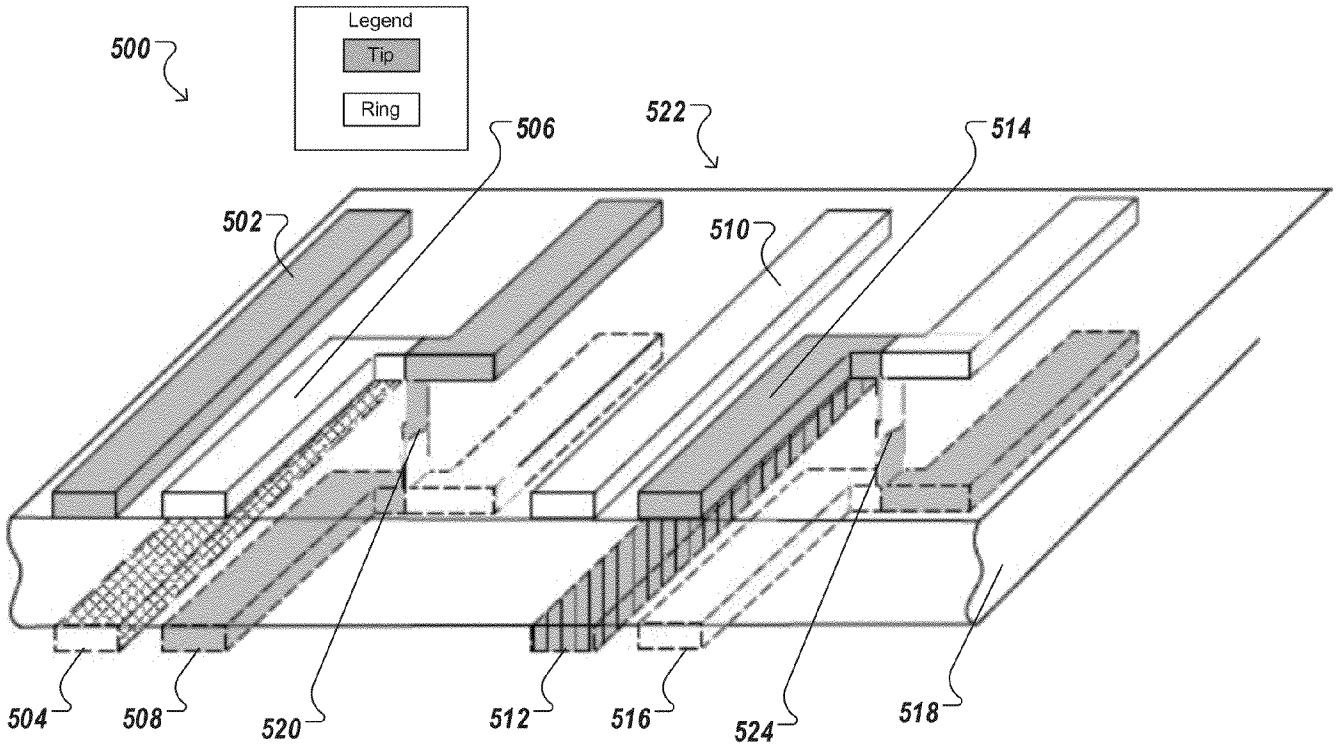
FIG. 10B is a perspective view of an example compensation region.

FIG. 10B is a perspective view of an example compensation region 500. Note that for purposes of illustration and clarity, FIG. 10B is not drawn to scale. The compensation region 500 includes conductors 502, 504, 506, 508, 510, 512, 514, and 516 that are formed on a substrate 518. The substrate 518 can be, for example, a multi-layered PCB, and the conductors can either be formed on outer surfaces of the PCB (as shown) or on various layers of the PCB.

Conductors 502 and 504 are a single pair of conductors (also referred to as a conductor pair), as are each of conductors 506 and 508, 510 and 512, and 514 and 516. The conductor pair 506 and 508 are a nearest neighbor pair relative to the conductor pair 502 and 504, and the conductor pair 510 and 512 are a next nearest neighbor relative to the conductor pair 502 and 504.

The conductor pair 502 and 504 has a tip conductor on a top surface of the substrate 518 and a ring trace on a bottom surface of the substrate 518. The conductor pair 510 and 512, which is a next nearest neighbor of the conductor pair 502 and 504, has a ring conductor on the top surface of the substrate 518 and a tip conductor on the bottom surface of the substrate 518. As such, the conductor pair 510 and 512 is twisted relative to an orientation of the corresponding tip conductor and ring conductor of the connector interface.

For example, as illustrated by FIG. 2 the tip conductors (e.g., T1, T2, T3, . . . TN) of each conductor pair is located on one side of the connector interface, while the ring conductors (e.g., R1, R2, R3, . . . RN) of each conductor pair is located on the other side of the connector interface. Meanwhile, as illustrated by FIG. 10B, the conductor pair 510 and 512 have a different (e.g., twisted) tip and ring orientation than the conductor pair 502 and 504 and/or the tip/ring orientation of the connector interface. Therefore, the conductor pair 510 and 512 are considered to be twisted at a first end of the compensation region (e.g., relative to the conductor pair 502 and 504 and/or the tip/ring orientation of the connector interface), while the conductor pair 502 and 504 is considered to be untwisted relative to the tip/ring orientation of the connector interface. The conductor pair 506 and 508 are also twisted at the first end of the compensation region (e.g., relative to the conductor pair 502 and 504 and/or the tip/ring orientation of the connector interface), while the conductor pair 514 and 516 is not twisted at the first end of the compensation region.

The conductor pair 502 and 504 remain untwisted over the entire length of the compensation region, while the conductor pair 510 and 512, which is a next nearest neighbor pair relative to the conductor pair 502 and 504, maintains its twisted configuration over the length of the compensation region. As discussed above, the untwisted/twisted configuration between the conductor pair 502 and 504 and its next nearest neighbor pair 510 and 512 results in an antiphase crosstalk coupling (e.g., 180 degree crosstalk phase shift) between the conductor pairs 502/504 and 510/512 relative to the crosstalk between these pairs caused by the connector. The antiphase crosstalk coupling destructively interferes with the crosstalk caused by the connector, such that the crosstalk caused by the connector between these next nearest neighbor pairs is reduced and/or cancelled over the length of the compensation region.

As noted above, the conductor pair 506 and 508 are twisted at the first end of the compensation region. The orientation of the conductors 506 and 508 is maintained between the first end of the compensation region to the twist point 520. At the twist point, the conductor pair 506 and 508 are again twisted (e.g., through vias) so that the orientation of the tip conductor and ring conductor are swapped. That is, at the twist point 520, the ring conductor 506 is routed through a via from the top side of the substrate 518 to the bottom side of the substrate 518, while the tip conductor 508 is routed through another via from the bottom side of the substrate 518 to the top side of the substrate 518. This orientation of the ring conductor 506 and tip conductor 508 is then maintained over a second portion of the compensation region that extends from the twist point 520 to a second end 522 of the compensation region.

As illustrated by FIG. 10B, when the conductor pair 506 and 508 are twisted, these conductor are also formed closer to the conductor pair 510 and 512. That is, over the first portion of the compensation region (e.g., between the first end of the compensation region and the twist point 520), the spacing between the conductor pair 506/508 and the conductor pair 502/504 is smaller than the spacing between the conductor pair 510/512 and the conductor pair 506/508. After the twist point, the conductor pair 506/508 is shifted over closer to the conductor pair 510/512, such that the spacing between the conductor pair 510/512 and the conductor pair 506/508 is smaller than the spacing between the conductor pair 502/504 and the conductor pair 506/508. These relative spacings between the conductor pairs results in the connector crosstalk between the conductor pair 502/504 and the conductor pair 506/508 to be reduced over the first portion of the compensation region, while the connector crosstalk between the conductor pair 506/508 and the conductor pair 510/512 to be reduced over the second portion of the compensation region.

The conductor pair 514/516 has a similar configuration as the conductor pair 506/508, but the tip/ring orientation of the conductor pair 514/516 is inverted relative to the tip/ring orientation of the conductor pair 506/508. For example, in the first portion of the compensation region, the tip conductor 514 on the top of the substrate 518, while the tip conductor 508 is located on the bottom of the substrate, and the ring conductor 516 is located on the bottom of the substrate 518, while the ring conductor 506 is located on the top of the substrate. In the second portion of the compensation region (e.g., from the twist points 520 and 524 to the second end 522 of the compensation region), the tip conductor 514 is located on the bottom of the substrate 518, while the tip conductor 508 is located on the top of the substrate 518, and the ring conductor 516 is located on the top of the substrate 518, while the ring conductor 506 is located on the bottom of the substrate 518. In this way, pair 506/508 is inverted relative to next nearest neighbor pair 514/516 over the entire length of the compensation region.

Figure 10C:
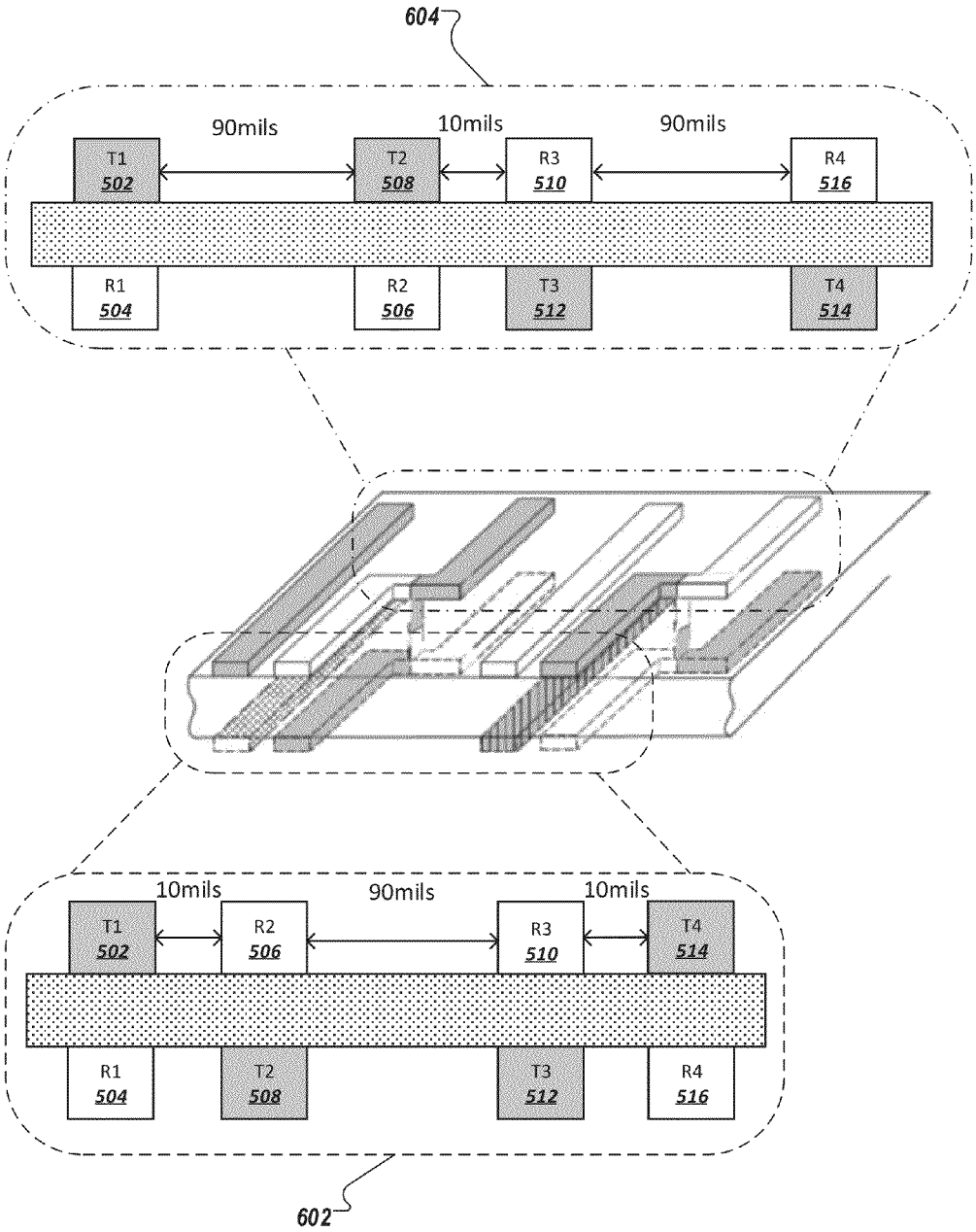
FIG. 10C is another perspective view of the example compensation region showing configuration details at each end of the compensation region.

FIG. 10C is another perspective view of the example compensation region 500. FIG. 10C shows configuration details at each end of the compensation region 500. Enlarged views 602 and 604 of the ends of the compensation region 500 show the relative orientations of, and spacings between, the conductors. For example, the enlarged view 602 shows that, at the first end of the compensation region, the conductor pair 502/504 is located 10 mils away from the conductor pair 506/508. Meanwhile, the enlarged view 604 shows that, at the second end of the compensation region, the conductor pair 502/504 is located 90 mils away from the conductor pair 506/508. The difference in spacing between the conductor pairs 502/504 and 506/508 is due to the shift of the conductors discussed above with reference to FIG. 10B. The enlarged views 602 and 604 also show other spacing differences between other conductor pairs from the first end of the compensation region to the second end of the compensation region.

The enlarged view 604 also shows that the orientation of the conductors 506 and 508 at the second end of the compensation region is inverted relative to the orientation of these same conductors at the first end of the compensation region. This inverted orientation is due to the twist of the conductors 506 and 508 at the twist point 520 of FIG. 10B. The orientation of conductors 514 and 516 at the second end of the compensation region are similarly inverted relative to the orientation of the conductors 514 and 516 at the first end of the compensation region. This inverted orientation is similarly a result of twisting the conductors 514 and 516 at the twist point 524 of FIG. 10B.

Note that the spacings shown in FIG. 10C are for purposes of illustration, and other spacings can be used depending on the amount and type (e.g., near end and/or far end) crosstalk that are to be cancelled. The spacings may also vary depending on the length of the compensation region that will be used or the type of connector inducing the initial crosstalk.

Figure 11:
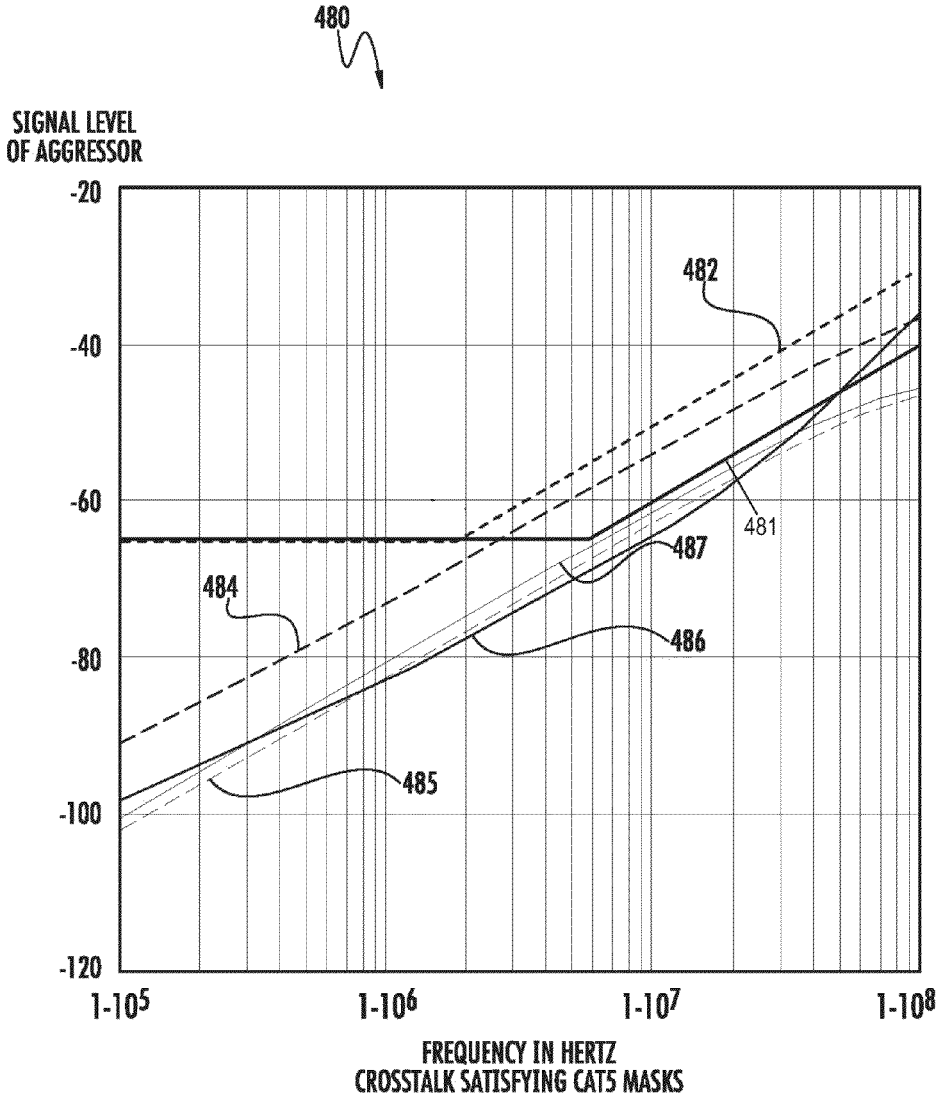
FIG. 11 is another graph similar to those shown in FIGS. 7-9 and showing the performance of a CAT 5 compensator in accordance with a non-limiting example.

FIG. 11 is a graph showing the performance of a CAT5 compensator with the CAT5 NEXT mask shown at 481 and the CAT5 FEXT mask shown at 482. The FEXT from the nearest neighbor is shown at 484 and the FEXT from the next-nearest neighbor is shown at 485. The NEXT from the nearest neighbor is shown at 486 and the NEXT from the next-nearest neighbor is shown at 487.

Figure 12:
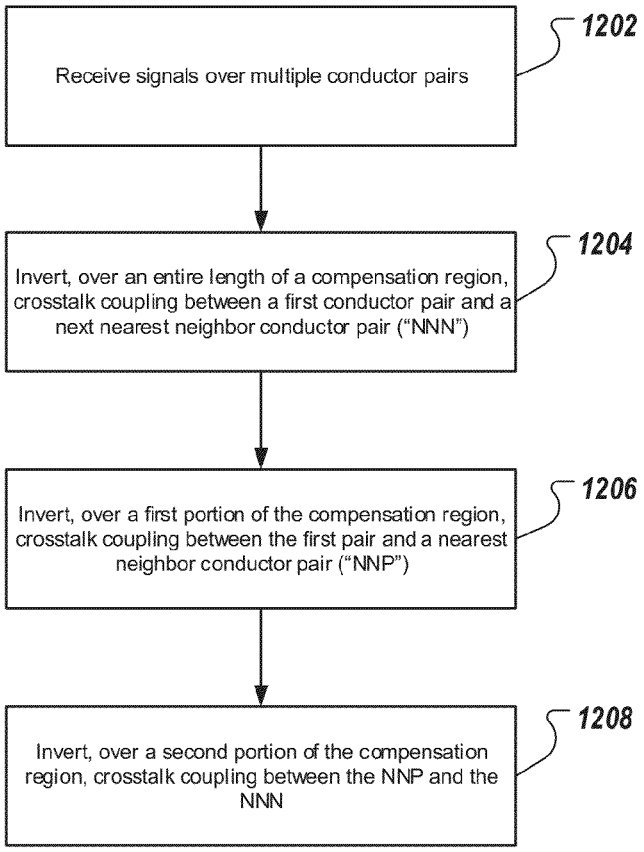
FIG. 12 is a flow chart of an example process for cancelling crosstalk.

FIG. 12 is a flow chart of an example process 1200 for cancelling connector crosstalk. The process 1200 can be initiated by receiving signals over multiple conductor pairs (1202). The signals can be received, for example, from a connector that is connected to a PCB. The received signals may be distorted by crosstalk among the conductor pairs that is caused by the configuration of the connector.

The conductor pairs over which the signals are received can include three or more different conductor pairs. For example, first signals can be received over a first conductor pair, while second signals and third signals can be respectively received over a second conductor pair and a third conductor pair. For example, the first conductor pair ("first pair") can be the conductor pair 502/504 of FIG. 10B, the second conductor pair can be a nearest neighbor pair ("NNP") (e.g., conductor pair 506/508 of FIG. 10B) relative to the first conductor pair, and the third conductor pair can be a next nearest neighbor pair ("NNN") (e.g., conductor pair 510/512 of FIG. 10B) relative to the first conductor pair. As discussed above, with reference to the first pair, the NNP is adjacent to the first pair and is located between the first pair and the NNN.

Crosstalk coupling between the first pair and the NNN are inverted over a given length of a compensation region (1204). In some implementations, the crosstalk coupling between the first pair and the NNN is inverted over an entire length of the compensation region. The crosstalk coupling between the first pair and the NNN can be inverted, for example, by twisting the NNN pair (e.g., relative to the first pair) at a first end of the compensation region.

Twisting the NNN relative to the first pair can be achieved by inverting the tip/ring orientation of the NNN relative to the tip/ring orientation of the first pair. For example, as illustrated in FIG. 10B, the NNN (e.g., conductor pair 510/512) of the conductor pair 502/504 has an opposite tip/ring orientation relative to the conductor pair 502/504. In particular, over the length of the compensation region, the tip 502 is on the top of the substrate 518, while the tip 512 is on the bottom of the substrate 518. Similarly, the ring 504 is on the bottom of the substrate 518, while the ring 510 is on the top of the substrate 518.

Twisting the NNN pair relative to the first pair changes the polarity of the crosstalk coupling between the NNN and the first pair, which results in inverted crosstalk coupling between the NNN and the first pair (e.g., relative to the connector induced crosstalk distortion). The inverted crosstalk coupling has an antiphase relative to the connector induced crosstalk distortion, and can be maintained over the entire length of the compensation region so that the connector induced crosstalk distortion can be cancelled.

Crosstalk coupling between the first pair and an NNP is inverted (1206). In some implementations, the crosstalk coupling between the first pair and the NNP is inverted over a first portion of the compensation region. The first portion of the compensation region can be, for example, a length of the compensation region that is less than the entire length of the compensation region. For example, in FIG. 10B, the first portion of the compensation region can extend from the first end of the substrate 518 (e.g., front end in the perspective view) to the twist point 506.

In some implementations, the crosstalk coupling between the first pair and the NNP can be inverted by twisting the NNP relative to the first pair. Twisting the NNP relative to the first pair can be achieved, for example, by inverting the tip/ring orientation of the NNP relative to the tip/ring orientation of the first pair. For example, as illustrated in FIG. 10B, in the first portion of the compensation region, the ring 506 is on the top of the substrate 518, while the ring 504 is on the bottom of the substrate 518, and the tip 508 is on the bottom of the substrate 518, while the tip 502 is on the top of the substrate.

Twisting the NNP relative to the first pair changes the polarity of the crosstalk coupling between the NNP and the first pair, which results in inverted crosstalk coupling between the NNP and the first pair (e.g., relative to the connector induced crosstalk distortion). The inverted crosstalk coupling may cancel the connector induced crosstalk distortion over the first portion of the compensation region.

Crosstalk coupling between the NNP and the NNN is inverted (1208). In some implementations, the crosstalk coupling between the NNP and the NNN is inverted over a second portion of the compensation region. The second portion of the compensation region can be, for example, a length of the compensation region that is less than the entire length of the compensation region. For example, in FIG. 10B, the second portion of the compensation region can extend from the twist point 520 to the second end 522 of the compensation region.

In some implementations, the crosstalk coupling between the NNP and the NNN can be inverted by twisting the NNP relative to the NNN. Twisting the NNP relative to the NNN can be achieved, for example, by inverting the tip/ring orientation of the NNP relative to the tip/ring orientation of the NNN. For example, as illustrated in FIG. 10B, in the second portion of the compensation region, the ring 506 is on the bottom of the substrate 518, while the ring 510 is on the top of the substrate 518, and the tip 508 is on the top of the substrate 518, while the tip 512 is on the bottom of the substrate 518.

Twisting the NNP relative to the NNN changes the polarity of the crosstalk coupling between the NNP and the NNN, which results in inverted crosstalk coupling between the NNP and the NNN (e.g., relative to the connector induced crosstalk distortion). The inverted crosstalk coupling has an antiphase relative to the connector induced crosstalk distortion, and therefore, may cancel the connector induced crosstalk distortion over the second portion of the compensation region.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A device, comprising:

a PCB including a compensation region of a given length that reduces crosstalk caused between pairs of conductors by a connector;

a first pair of conductors ("first pair") extending the given length of the compensation region and having a first tip conductor on a first layer of the PCB and a first ring conductor on a second layer of the PCB;

a nearest neighbor pair of conductors ("NNP") adjacent to the first pair, the NNP having a second tip conductor and a second ring conductor; and a next nearest neighbor pair of conductors ("NNN") adjacent to the nearest neighbor pair of conductors, the NNN having a third tip trace formed over the given length of the second layer of the PCB and a third ring trace formed over the given length of the first layer of the PCB, wherein:

the NNP is located between the first pair and the NNN; and the second tip conductor and second ring conductor are twisted at a twist point of the compensation region.

2. The device of claim 1, wherein:

the second tip conductor is formed on the second layer of the PCB over a first portion of the compensation region that extends from a first end of the compensation region to the twist point; and the second ring conductor is formed on the first layer of the PCB over the first portion of the compensation region.

3. The device of claim 2, wherein the second tip conductor is formed on the first layer of the PCB over a second portion of the compensation region that extends from the twist point to a second end of the compensation region; and the second ring conductor is formed on the second layer of the PCB over the second portion of the compensation region.

4. The device of claim 3, wherein:

a first via and a second via are formed in the PCB at the twist point;

the second tip conductor is routed through the first via from the second layer of the PCB to the first layer of the PCB; and the second ring conductor is routed through the second via from the first layer of the PCB to the second layer of the PCB; and routing the second tip conductor through the first via and the second ring conductor through the second via changes a polarity of crosstalk between the NNP and each of the first pair and the NNN.

5. The device of claim 4, wherein, over the first portion of the compensation region, the second tip conductor and the second ring conductor are formed closer to the first pair than the NNN.

6. The device of claim 5, wherein, over the second portion of the compensation region, the second tip conductor and the second ring conductor are formed closer to the NNN than the first pair.

7. The device of claim 5, wherein structure of the compensation region comprising separations between pairs of conductors, the given length of the compensation region, and a location of the twist point is selected to optimize cancellation of various crosstalk couplings between pairs of conductors.

8. The device of claim 7, wherein the structure is selected to optimize near end crosstalk cancellation.

9. The device of claim 7, wherein the structure is selected to optimize far end crosstalk cancellation.

10. The device of claim 7, wherein the structure is selected to optimize both near and far end crosstalk cancellation.

11. The device of claim 7, wherein the structure is selected optimize cancellation of crosstalk to the NNP and second NNP only.

12. The device of claim 2, wherein the connector mated to the compensation region is a miniature ribbon connector, and a mated combination of the miniature ribbon connector and the compensation region are CAT5 compliant.

13. A device, comprising:

a PCB including a crosstalk compensation region of a given length; and a connector connected to a first end of the crosstalk compensation region, wherein a configuration of conductor pairs in the connector cause first phase crosstalk between the conductor pairs; and wherein the compensation region comprises:

a first pair of untwisted conductors over the given length;

a next nearest neighbor pair of conductors ("NNN") that are twisted at the first end of the compensation region, wherein the NNN are electrically coupled with the first pair to cause, over the given length of the compensation region, first antiphase crosstalk between the NNN and the first pair, wherein the first antiphase crosstalk is a destructive interference signal relative to the first phase crosstalk created between the NNN and first pair by the connector; and a nearest neighbor pair of conductors ("NNP") that are located between the first pair and the NNN, wherein the nearest neighbor pair are twisted at the first end of the compensation region and twisted at a twist point of the compensation region, and wherein:

over a first portion of the crosstalk compensation region that is between the first end and the twist point, the NNP are electrically coupled with the first pair to cause the first antiphase crosstalk between the NNP and the first pair; and over a second portion of the crosstalk compensation region that is between the twist point and a second end of the crosstalk compensation region, the NNP are electrically coupled with the NNN to cause second antiphase crosstalk between the NNP and NNN, wherein the second antiphase crosstalk has a 180 degree phase shift relative to the first phase crosstalk created between the NNP and the NNN by the connector.

14. The device of claim 13, wherein the given length and spacings between the first pair, the NNP, and the NNN, and a distance from the first end to the twist point, are selected to cancel at least a threshold amount of near end crosstalk or far end crosstalk over the compensation region.

15. A method comprising:

receiving first a signal from a connector at a first pair of traces ("first pair"), a second signal from the connector at a nearest neighbor pair of traces ("NNP") that are adjacent to the first pair of traces, and a third signal from the connector at a next nearest neighbor pair of traces ("NNN") that are adjacent to the nearest neighbor pair of traces, wherein the first signal, the second signal, and the third signal each include first crosstalk distortion induced by the connector;

inverting, over a compensation region of a given length, crosstalk coupling between the NNN and the first pair;

inverting, over a first portion of the given length of the compensation region, crosstalk coupling between the NNP and the first pair; and inverting, over a second portion of the given length of the compensation region, crosstalk coupling between the NNP and the NNN, wherein the first portion and the second portion are different portions of the given length of the compensation region.

16. The method of claim 15, wherein inverting crosstalk coupling between the NNN and the first pair comprises:

inverting, at a first end of the compensation region, a tip/ring orientation of the NNN relative to a tip/ring orientation of the first pair; and maintaining, across the given length of the compensation region, each of the inverted tip/ring orientation of the NNN and the tip/ring orientation of the first pair.

17. The method of claim 15, wherein inverting crosstalk coupling between the NNP and the first pair comprises;

inverting, at a first end of the compensation region, a tip/ring orientation of the NNP relative to a tip/ring orientation of the first pair; and maintaining, across a first portion of the given length extending from a first end of the compensation region to a twist point, the inverted tip/ring orientation of the NNP and the tip/ring orientation of the first pair.

18. The method of claim 17, wherein inverting crosstalk coupling between the NNP and the NNN comprises:

inverting, at the first end of the compensation region, a tip/ring orientation of the NNN relative to a tip/ring orientation of the first pair;

reverting, at the twist point, the inverted tip/ring orientation of the NNP to match the tip/ring orientation of the first pair; and maintaining, across a second portion of the given length extending from the twist point to a second end of the compensation region, the reverted tip/ring orientation of the NNP and the inverted tip/ring orientation of the NNN.

19. The method of claim 18, wherein:

across the first portion of the compensation region, crosstalk between the first pair and each of the NNP and the NNN have an antiphase relative to a phase of crosstalk caused by the connector; and across the second portion of the compensation region, crosstalk between the NNN and each of the NNP and the first pair have an antiphase relative to the phase of crosstalk caused by the connector.

* * * * *